US005901620A

United States Patent [19]

Arnold

[11] Patent Number: 5,901,620

[45] **Date of Patent: *May 11, 1999**

[54] SOCKETS FOR A RATCHET WRENCH

[75] Inventor: Robert L. Arnold, Jacobus, Pa.

[73] Assignee: Hand Tool Design Corporation, Wilmington, Del.

[ * ] Notice: This patent is subject to a terminal disclaimer.

[21] Appl. No.: 08/904,177

[22] Filed: Jul. 31, 1997

[51] Int. Cl.[6] ..... B25B 13/46

[52] U.S. Cl. ..... 81/63.2; 81/60; 81/177.2

[58] Field of Search ..... 81/58.1, 60–63.2, 81/177.2

[56] References Cited

U.S. PATENT DOCUMENTS

| | | | |
|---|---|---|---|
| Re. 19,341 | 10/1934 | McNaught et al. . | |
| 747,750 | 12/1903 | Murch . | |
| 858,894 | 7/1907 | Moss | 81/63.2 |
| 896,607 | 8/1908 | Zeller . | |
| 1,413,243 | 4/1922 | Thompson | 81/63.1 |
| 1,902,878 | 3/1933 | McNaught et al. . | |
| 2,300,479 | 11/1942 | Wilson . | |
| 2,570,779 | 10/1951 | Dodge et al. . | |
| 2,708,855 | 5/1955 | Fish . | |
| 3,349,653 | 10/1967 | Kaufman et al. . | |
| 3,575,069 | 4/1971 | White | 81/62 X |
| 4,111,077 | 9/1978 | Cummings et al. . | |
| 4,328,720 | 5/1982 | Shiel . | |
| 4,515,044 | 5/1985 | Harstad . | |
| 4,561,329 | 12/1985 | Lack . | |
| 4,562,757 | 1/1986 | Furey . | |
| 4,991,468 | 2/1991 | Lee . | |
| 4,993,288 | 2/1991 | Anderson et al. . | |
| 5,140,875 | 8/1992 | Kim . | |
| 5,499,560 | 3/1996 | Aeschliman . | |
| 5,794,496 | 8/1998 | Arnold | 81/63.2 |

*Primary Examiner*—James G. Smith
*Attorney, Agent, or Firm*—Leonard Bloom

[57] ABSTRACT

A socket to be received in the opening in the head of a low profile ratchet wrench. The ratchet wrench has an annular lip formed partially circumferentially about the opening in the head. The socket has a first axial portion and an integral second axial portion. An opening which has surfaces to engage a fastener is formed in the first axial portion. An opening is formed in the second axial portion which communicates with the opening in the first axial portion. A ratchet gear is formed externally on the second axial portion. The socket is resiliently retained in the opening and is manually insertable and removable from the ratchet wrench. A set of sockets is provided, each having a ratchet gear of the same cross section and each having an opening in the first axial portion which is of a different size to engage a fastener of a predetermined size. An adapter is provided to permit the use of ratchet wrench with conventional sockets and accessories.

13 Claims, 9 Drawing Sheets

SOCKETS FOR A RATCHET WRENCH

BACKGROUND OF THE INVENTION

The present invention relates to a ratchet wrench and, more particularly, to a socket having a gear formed on an external portion thereof for use in a low profile wrench.

It is highly desirable to have a ratchet wrench to rapidly tighten and loosen fasteners and to do so without removing the wrench from the fastener. It is particularly advantageous for the ratchet wrench to have a low profile wherein the wrench is more easily used in confined spaces where the height of the combined wrench head and attached socket are factors in being able to tighten and/or loosen a fastener.

Low profile ratcheting wrenches are disclosed in the following:

| U.S. Pat. No. | Inventor(s) |
|---|---|
| 747,500 | Murch |
| 896,607 | Zeller |
| Re 19,341 | McNaught et al |
| 2,570,779 | Dodge et al |
| 2,708,855 | Fish |
| 3,349,653 | Kaufman et al |
| 3,742,788 | Priest |

These wrenches further include a drive member having teeth around an outer periphery, the drive member engaging the fastener. In this manner, these wrenches differ from the more conventional ratchet wrench which have a gear formed with an external tang and a socket fitted to the tang so that the socket engages the fastener. However, a major disadvantage of these devices in that there are no interchangeable sockets or means to use the wrench with fasteners of differing sizes. The wrenches are useful with only one size fastener and a separate wrench must be used for a fastener of a different size.

The following disclose a wrench having teeth on the exterior of the drive gear with replaceable sockets or means to use the wrench with fasteners of different sizes.

U.S. Pat. No. 2,300,479 to Wilson, discloses interchangeable heads. The heads are replaced by removal of a spring actuated pin from a bore. The lower end of the head is provided with an annular ring of ratchet teeth adapted to engage and cooperate with ratchet teeth formed on the circular lip of a bore in the body member.

U.S. Pat. No. 4,515,044 to Harstad discloses a ratchet wrench sized to fit in an opening in the head. Ratchet teeth are located in a groove around the periphery of the cylinder and a pawl engages the ratchet teeth. A selected socket is inserted in the head opposite to a lip and the pawl lever is cleared from the cylindrical opening. When the pawl lever is released, the pawl engages the ratchet and retains the cylinder in the head.

U.S. Pat. No. 4,561,329 to Lock discloses a ratchet wrench having a drum with multiple drum teeth on an outer periphery and a tang drive recessed in the drum. The drum is retained with a ratchet drum ring. Conventional sockets are fitted to the drive tang.

U.S. Pat. No. 4,562,757 to Furey discloses a high torque socket open-ended ratchet wrench with a split ring-like socket head and expandable yoke. Secured to each socket member is a curved ratchet which, in combination, define a continuous ratchet wheel. Each curved ratchet includes a series of teeth for engaging a pawl carried on the fixed yoke member.

U.S. Pat. No. 4,991,468 to Lee discloses a drive wheel having peripheral teeth on the outer surface which are engaged by a pawl and inner axial teeth about an opening in the drive wheel. A plurality of sockets are provided, each having peripheral teeth cooperating with the inner axial teeth of the drive wheel and retained in the wrench by a pair of ring detents. The replaceable sockets have teeth internally and externally.

The following disclose wrenches which have teeth around the periphery of a socket.

Cummings et al, U.S. Pat. No. 4,111,077 disclose a sprocket formed with teeth on the outer periphery which is rotatably held in apertures between head portions.

Shiel, U.S. Pat. No. 4,328,720 discloses a socket wrench and set wherein a hollow drive ring is retained in the annular head with a through opening and is rotatable in both directions. It has a ratcheted outer peripheral portion with teeth and an interior female drive ring portion with a prismatic driving inner periphery at one end and a circular cylindrical inner periphery at the other end joined by a flat shelf. A ratcheted pawl is pivotly mounted on the handle for engagement with the ratcheted outer peripheral portion. A series of removable sockets is provided. Each removable socket has corner edges crossed by recesses to permit engagement by a retention ring which is received in an annular recess within the drive ring.

Anderson et al, U.S. Pat. No. 4,993,288 disclose a power driven replacement socket ratchet wrench. The sockets have a splined tooth exterior of the same cross-sectional dimension to be received in a socket retainer ring in the head. A groove is formed on the exterior of the socket, the groove aligning with retainer lugs on the retainer ring. The retainer lugs and groove permit retention and removal of the socket of various bores to be used with a corresponding size nut. The socket has a center opening so that the socket can be slid down along an elongated stud to engage a nut. A driven pawl member engages the teeth on the outer surface of the socket.

U.S. Pat. No. 5,140,875 to Kim discloses a socket wrench having a main socket member in the handle. Within the main socket member, is a main outer socket, a plurality of main socket units and auxiliary socket units, which are concentric with one another. Each socket has teeth portions on the inner and outer circumferential surfaces.

However, none of the references suggest nor disclose a ratchet wrench which combines a drive socket with gear teeth in an integral unit to provide a low profile wrench.

Patent application Ser. No. 08/760,734 to Arnold filed Dec. 5, 1996, discloses a pawl module to be used in a ratchet wrench with sockets having gear teeth on an external portion of the socket. Patent application Ser. No. 08/888/314 to be assigned to Arnold filed Jul. 14, 1997, discloses a plastic identification insert on sockets having external gear teeth.

Thus, there exists a need for a low profile ratchet wrench which has replaceable sockets to fit a plurality of fasteners, and which has gear teeth integral with the socket.

BRIEF SUMMARY OF THE INVENTION

It is an object of the present invention to provide a low profile ratchet wrench with replaceable sockets having gear teeth integral with the socket.

It is still another object of the present invention to provide a low profile ratchet wrench which is economical to fabricate, is easy to assemble, is easily maintained and repaired and can be utilized in confined spaces with fasteners mounted on elongated bolts.

In accordance with the teachings of the present invention, there is disclosed a socket to be received in an opening in a head of a ratchet wrench and to cooperate with a pawl means disposed in the head of the ratchet wrench. The socket includes a first axial portion and an integral second axial portion. The first axial portion has an opening therein. The opening has surfaces for engaging a fastener of a predetermined size. The second axial portion has an end distal from the first axial portion. An annular shoulder is formed on said end. A ratchet gear is formed externally axially and circumferentially on the second axial portion. An external annular groove is formed between the annular shoulder and the ratchet gear on the second axial portion. A resilient means is disposed in the head of the ratchet wrench. The resilient means cooperates with external annular groove wherein the socket is manually insertable and removable from the head of the ratchet wrench.

In further accordance with the teachings of the present invention, there is disclosed a low profile ratchet wrench having a handle and a head. The head has an upper face and a lower face. An opening is formed through the head between the upper face and the lower face. The opening has a first portion distal from the handle and a second portion proximal to the handle. An annular lip is formed at least partially circumferentially about the first portion of the opening. A reversing pawl is disposed in the second portion of the opening. The pawl has teeth oriented toward the first portion of the opening. A socket is removably received in the first portion of the opening and juxtapositioned to the teeth on the pawl. The socket has a first portion and an integral second portion. The second portion has a plurality of gear teeth formed circumferentially thereabout wherein the teeth on the pawl cooperate with the gear teeth. The first portion of the socket has an opening formed axially therein, the opening having surfaces therein for engaging a fastener of a predetermined size. A plurality of sockets, are interchangeably inserted in and removed from, the head of the wrench, each socket having an opening in the respective first portion to engage a fastener of a different predetermined size.

In another aspect, there is disclosed a low profile ratchet wrench having a handle and a head. The head has an upper face and a lower face. An opening is formed through the head between the upper face and the lower face. The opening has a first portion distal from the handle and a second portion proximal to the handle. A reversing pawl is disposed in the second portion of the opening, the pawl having teeth oriented toward the first portion of the opening. An adapter is removably received in the first portion of the opening and juxtapositioned to the teeth on the pawl. The adapter has a first portion and an integral second portion, the second portion has a plurality of gear teeth formed circumferentially thereabout wherein the teeth on the pawl cooperate with the gear teeth. The first portion of the socket has a drive tang formed thereon such that the drive tang may be received in a selected one of a plurality of conventional sockets for ratchet wrenches.

In still another aspect, there is disclosed a set of wrench sockets, each of which is intended to be received within an opening formed in the head of a hand-operated ratchet wrench and to cooperate therein directly with a pawl means in the ratchet wrench. The invention eliminates the necessity for a conventional ratchet gear in the ratchet wrench, and thereby substantially reduces the size of the ratchet wrench. Each of the wrench sockets has respective first and second axial portions. The first axial portions of the respective wrench sockets include respective socket openings, each of which has a different size. The second respective axial portions are identical for all of the wrench sockets. The second axial portion of each wrench socket has an annular shoulder at an end thereof and further has a ratchet gear formed externally thereon and intermediately of the second axial portion. The ratchet gear is intended to cooperate directly with the pawl means in the ratchet wrench. The second portion of the wrench socket further has an external annular groove formed thereon. The external annular groove is disposed between the ratchet gear and the annular shoulder and is adapted to cooperate with a resilient means in the head of the ratchet wrench, thereby manually releasably retaining any selected one of the set of wrench sockets within the head of the ratchet wrench.

These and other objects of the present invention will become apparent from a reading of the following specification taken in conjunction with the enclosed drawings.

DESCRIPTION OF THE PREFERRED EMBODIMENTS

Figure 2:
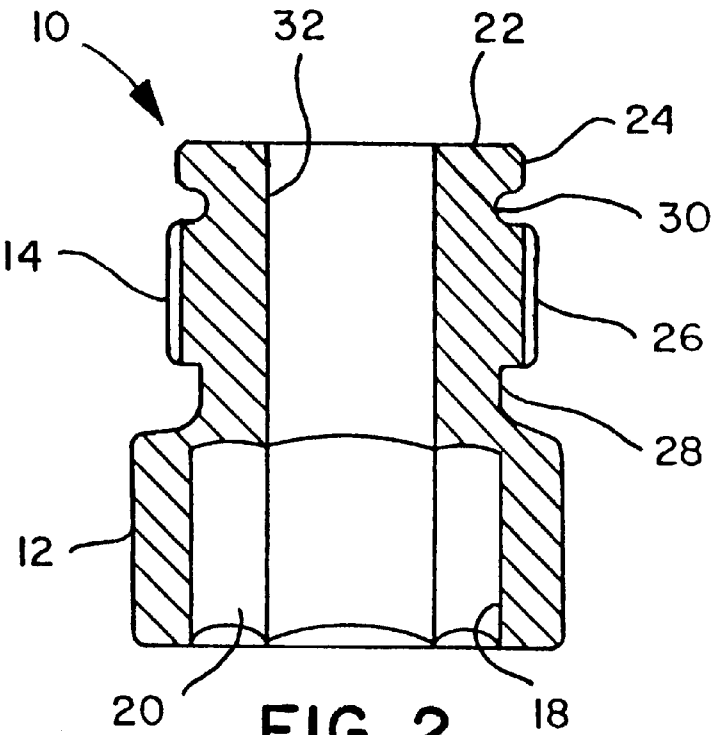
FIG. 2 is a cross-sectional view taken across the lines 2—2 of FIG. 1.
Figure 1:
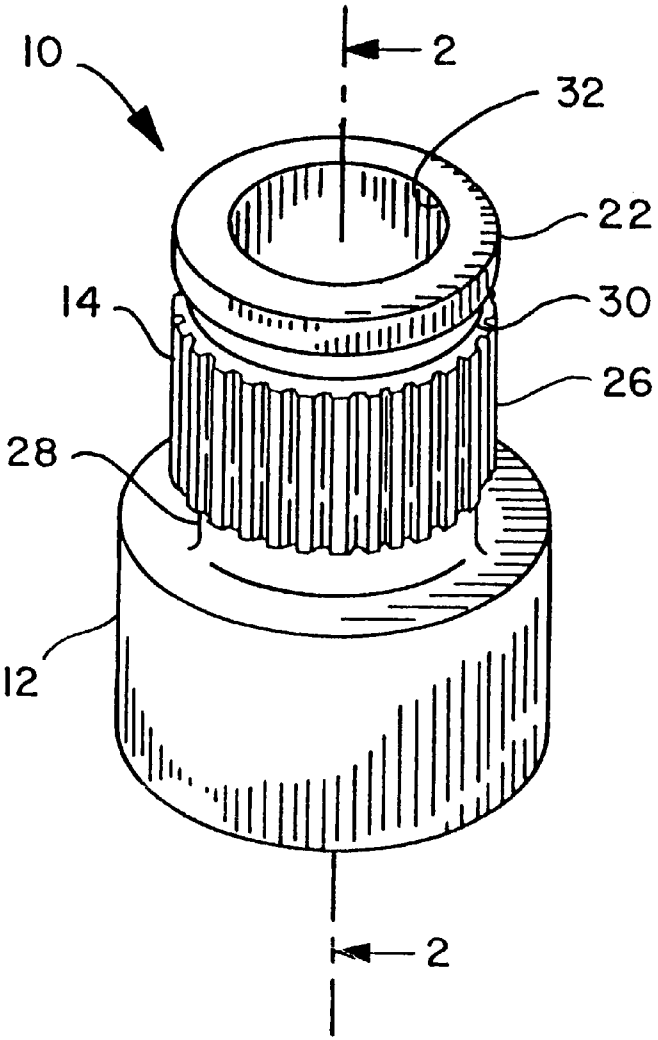
FIG. 1 is a perspective view of the socket of the present invention.
Figure 5:
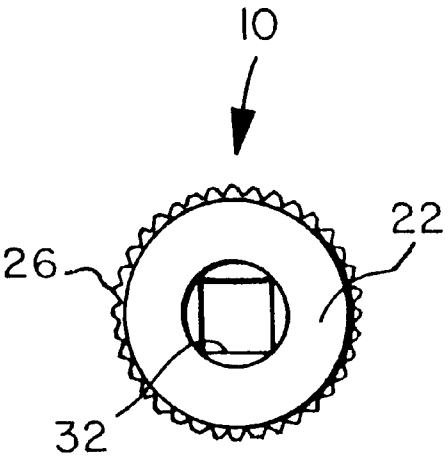
FIG. 5 is a top plan view of the socket of FIG. 3.
Figure 4:
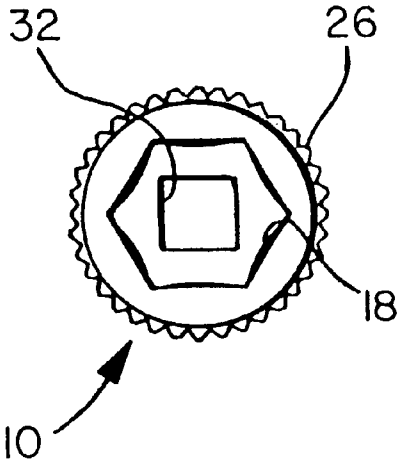
FIG. 4 is a bottom plan view of the socket of FIG. 3.
Figure 3:
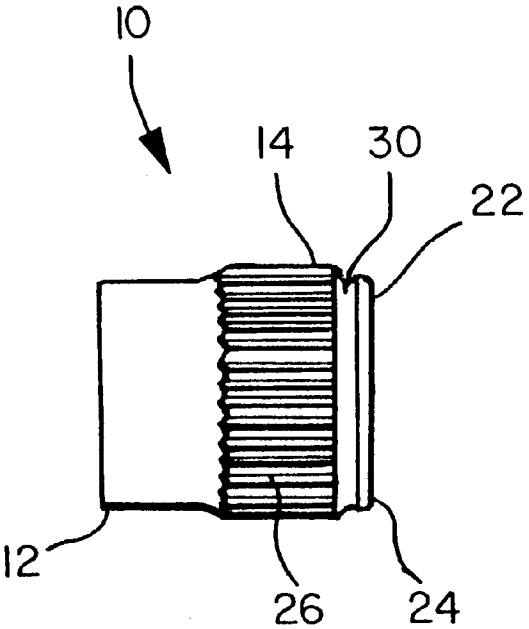
FIG. 3 is a side elevation view of the socket of the present invention which is for a smaller fastener.

In a typical low profile ratchet wrench of the prior art, the body and head of the wrench have a reduced height as compared to a conventional ratchet wrench, enabling the low profile ratchet wrench to be used in confined spaces. However, the typical low profile ratchet wrench has an extending tang which is received in a cooperating opening in the center of a conventional socket. Thus, height of the body of the wrench has been reduced but the socket remains a limiting feature on the overall system.

The ratchet wrench of the present application has overcome this deficiency by the use of a novel socket which incorporates the drive gear as an integral part of the socket and which enables the user to insert and remove sockets to be used with fasteners of various sizes.

Referring now to FIGS. 1–5, a socket 10 has a first axial portion 12 and a second axial portion 14 integral thereto. The first axial portion 12 has an opening 18 formed therein. The opening 18 has surfaces 20 formed axially therein. The surfaces 20 engage a fastener of a predetermined size. The surfaces 20 are of a type known to persons skilled in the art and may be of a conventional six point or twelve point type. Depending on the size of the opening 18 required to fit a fastener of a predetermined size wherein the size of the fastener may vary, the diameter of the first axial portion 12 of the socket may vary from socket to socket.

The second axial portion 14 of the socket 10 has an end 22 distal from the first portion 12 of the socket 10. An annular shoulder 24 is formed on the end 22. A plurality of gear teeth defining a ratchet gear 26 are formed externally, axially and circumferentially on the second portion 14 of the socket 10. In the sockets 10 in which the first axial portion 12 is of a size to fit a large fastener, the diameter of the first axial portion 12 is greater than the diameter of the ratchet gear 26 on the second axial portion 14. In order to more easily manufacture these sockets 10, a channel 28 is formed between the ratchet gear 26 and the first axial portion 12 of the socket 10. An external annular groove 30 is formed between the annular shoulder 24 and the ratchet gear 26 on the second axial portion 14 of the socket 10.

An opening 32 is formed in the second axial portion 14 of the socket 10. The opening 32 in the second axial portion 14 communicates with the opening 18 in the first axial portion 12 to form a through opening in the socket 10. Preferably, the opening 32 is circular and serves as a bolt hole clearance. Alternately, the opening 32 in the second portion of the socket 10 can be square (FIGS. 4 and 5) in shape and is of a size to receive the drive tang of a conventional ratchet wrench. In this manner, the socket 10 of the present invention can also be used in the same manner as a conventional socket.

Figure 6:
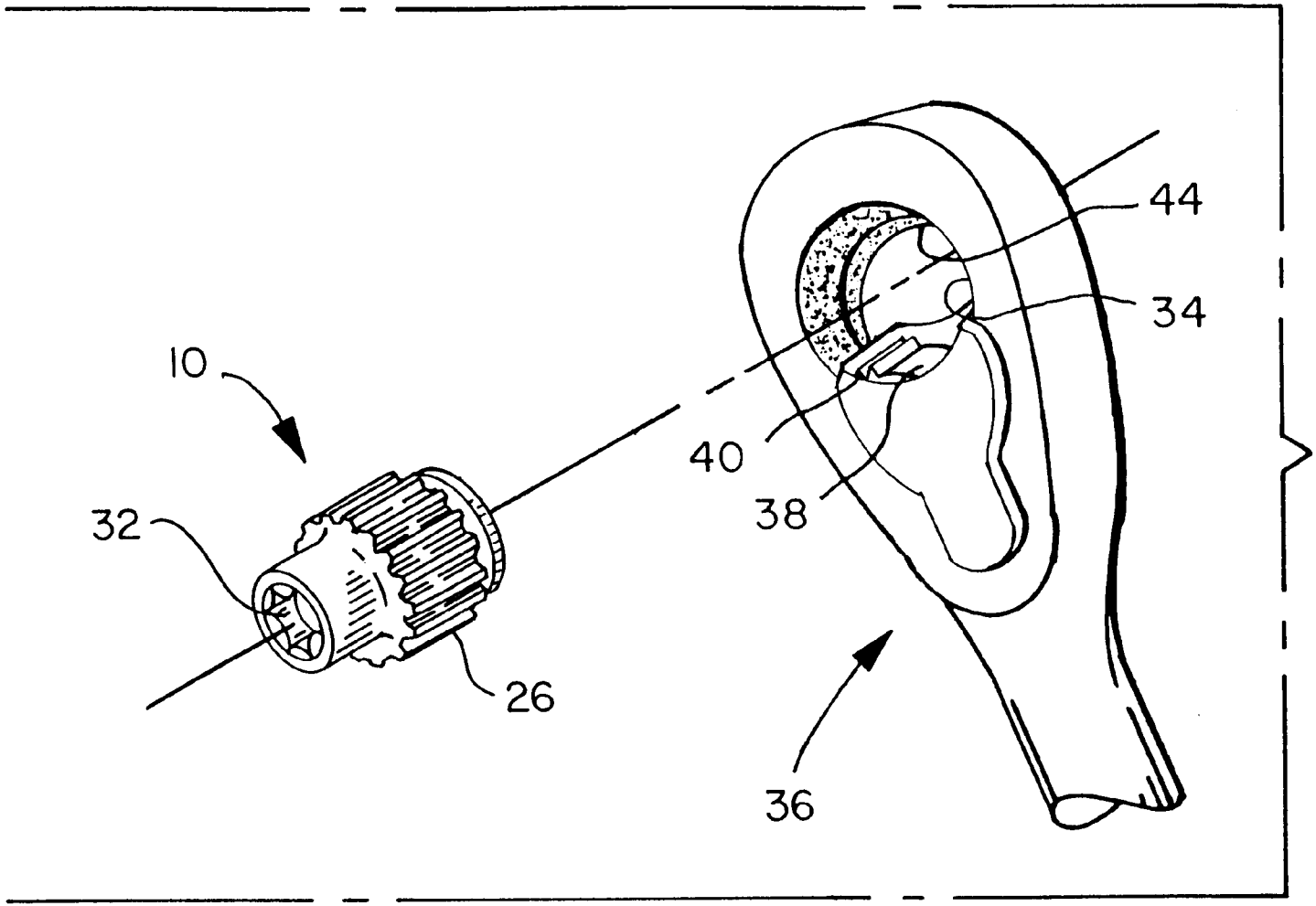
FIG. 6 is a perspective view of the socket of FIG. 3 being received in the opening in the head of a ratchet wrench.

As shown in FIG. 6, the socket 10 is received in an opening 34 in the head of a ratchet wrench 36. Preferably, the opening has a first portion distal from the handle and a second portion proximal to the handle. A pawl means 38 having teeth 40 thereon is disposed in the second portion of the opening in the ratchet wrench 36 with the teeth 40 communicating with the first portion of the opening 34 in the head. When the socket 10 is inserted in the first portion of the opening 34 in the ratchet wrench, the teeth 40 on the pawl means 38 engage the ratchet gear 26 on the socket 10 and permit ratcheting of the socket 10 by the ratchet wrench 36. Preferably, the pawl means 38 is connected to a reversing lever (not shown) to obtain forward and reverse drive of the socket 10.

Figure 8:
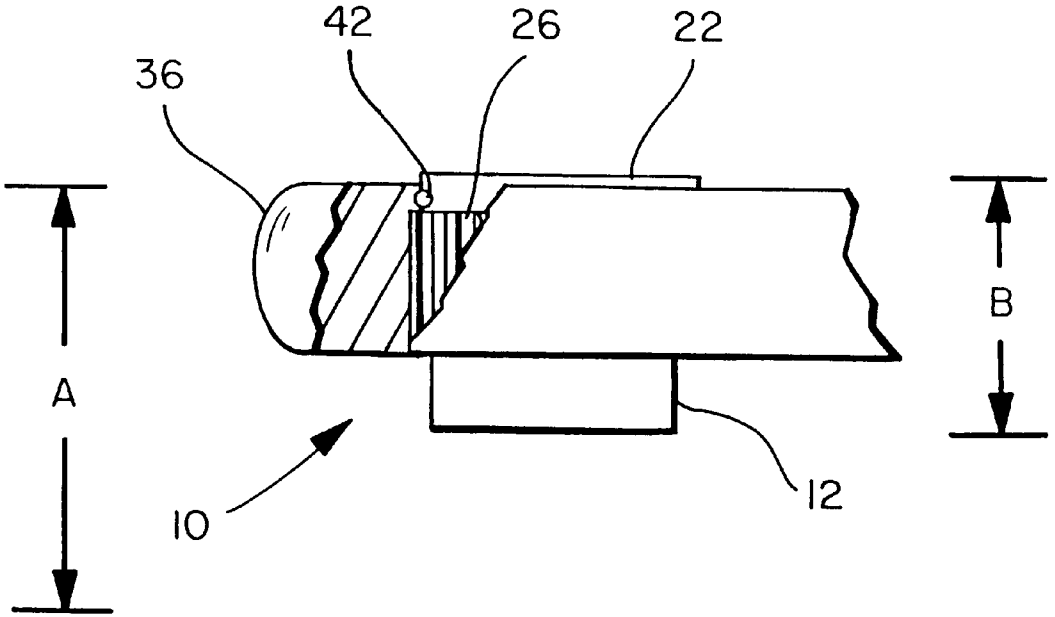
FIG. 8 is a partial cut-away side elevation view of the socket of the present invention received in the head of a ratchet wrench.
Figure 7:
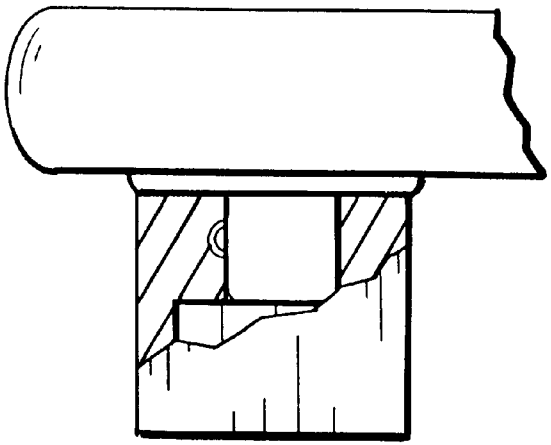
FIG. 7 PRIOR ART
FIG. 7 is a partial side elevation view of the prior art showing a socket mounted on a ratchet wrench.

FIG. 7 shows the prior art ratchet wrench and socket having an overall height A. The present ratchet wrench 36 and socket 10 are shown in FIG. 8 having an overall height B. Thus, it is readily seen that the profile of the ratchet wrench and socket of the present invention is significantly lower than the prior art.

Figure 9:
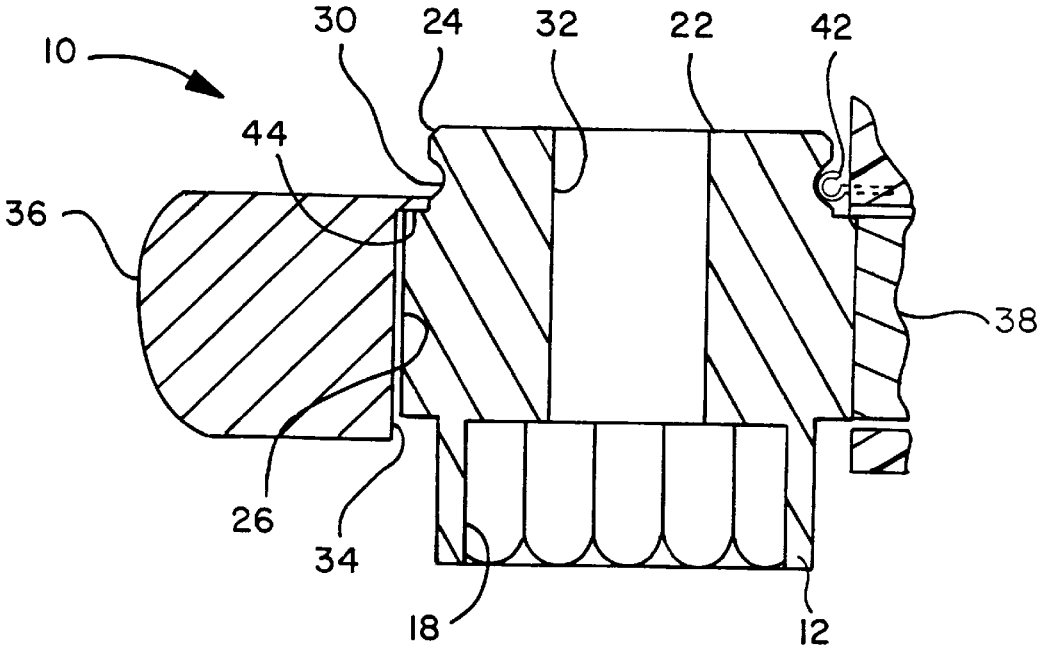
FIG. 9 is a cross-sectional view showing an embodiment in which the annular groove in the socket engages the resilient means.

The socket 10 is removably retained in the opening 34 in the head of the ratchet wrench by a resilient means 42 disposed in the opening 34 in the head and the resilient means cooperates with the annular groove 30 formed in the socket 10. In one embodiment the resilient means 42 is a wire ring. Alternately, the resilient means may be an elastomeric "O" ring. In one preferred embodiment (FIG. 9) a lip 44 is formed partially circumferentially about opening 34 in the head of the ratchet wrench 36, extending inwardly into the opening 34.

Figure 10:
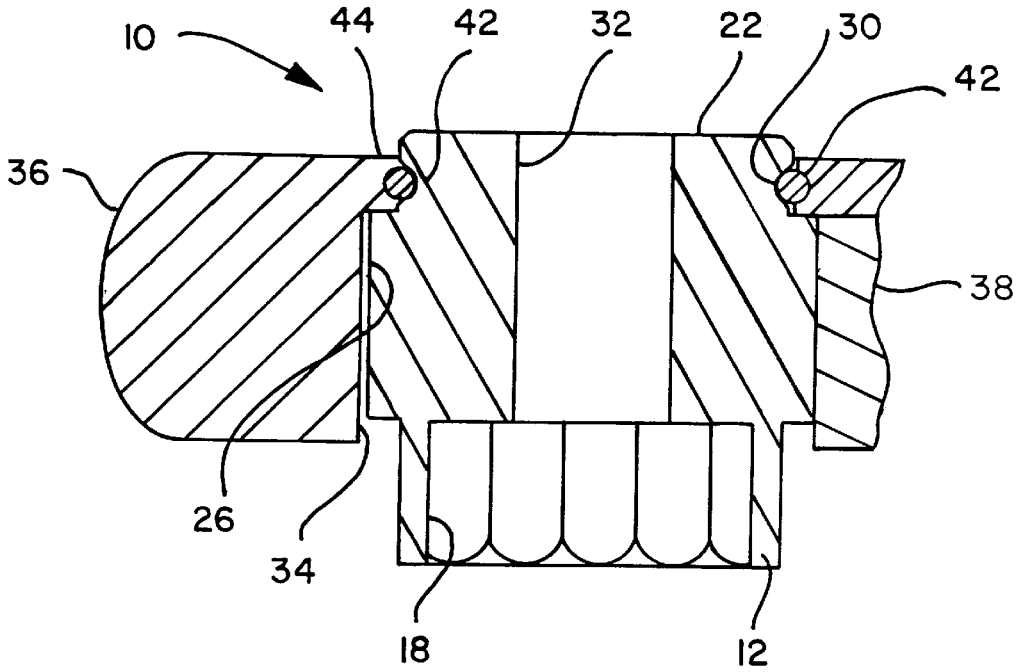
FIG. 10 is a cross-sectional view showing an embodiment in which the resilient means is disposed in a channel in the lip on the opening in the head.

In another preferred embodiment (FIG. 10) the lip is formed completely circumferentially about the opening 34.

When the second annular portion 14 of the socket 10 is inserted into the opening 34 from the direction of the bottom face of the head, the end 22 of the socket 10 which has a smaller diameter, does not contact the lip 44. The shoulder 24 contacts the resilient means 42 disposed in the opening 34 in the head and compresses the resilient means 42. Continued insertion of the socket 10, moves the shoulder 24 past the resilient means 42 which decompresses and is partially received in the annular groove 30 adjacent to the shoulder 24. In this manner, the resilient means is disposed partially in the opening in the head of the ratchet wrench and partially in the annular groove 30 in the socket and thereby releasably retains the socket 10 in the ratchet wrench. The reverse occurs when the socket 10 is removed from the ratchet wrench. Further insertion of the socket 10 is stopped by the lip 44 abutting the upper edge of the gear teeth 26. Thus, in using the ratchet wrench 36 with the socket 10 of the present invention, the lip 44 prevents the socket 10 from passing through the upper surface of the ratchet wrench when the user applies pressure to the ratchet wrench. The width of the annular groove 30 is approximately equal to but slightly greater than, the thickness of the resilient means 42. The annular groove 30 retains therein the fully expanded resilient means 42. The resilient means 42 may be a flexible finger or spring extending from the head of the wrench or from a pawl module. To remove the socket 10, the extending first portion 12 of the socket 10 is manually grasped and pulled away or alternately, the second portion 14 of the socket 10 is pushed in the opposite direction from the head of the ratchet wrench 36. To facilitate pushing the socket 10 from the top surface of ratchet wrench, the end 22 of the second portion 14 of the socket 10 extends above the top surface of the ratchet wrench.

In the other preferred embodiment (FIG. 10), the lip 44 has a thickness of approximately ⅛ inch and a channel 46 in the thickness of the lip 44 having a width of approximately 0.040 inch is formed annularly around the opening 34 in the head of the ratchet wrench 36. The resilient means 42 is disposed in the channel 46 in the lip 44. The resilient means may be a wire ring having a thickness of approximately 0.030 inch. The dimensions of the lip, channel and resilient means are for example only and are not limiting. The resilient means 42 is compressed as the socket 10 is inserted or removed and when the socket 10 is fully disposed in the opening 34, the resilient means 42 is disposed in the channel 46 in the lip 44 and in the opposing annular groove 30 in the socket 10 to retain the socket 10 in the ratchet wrench.

The means for releasably retaining the socket in the head of the ratchet wrench is not limited to the above described means but other means known to persons skilled in the art may be used.

Figure 11:
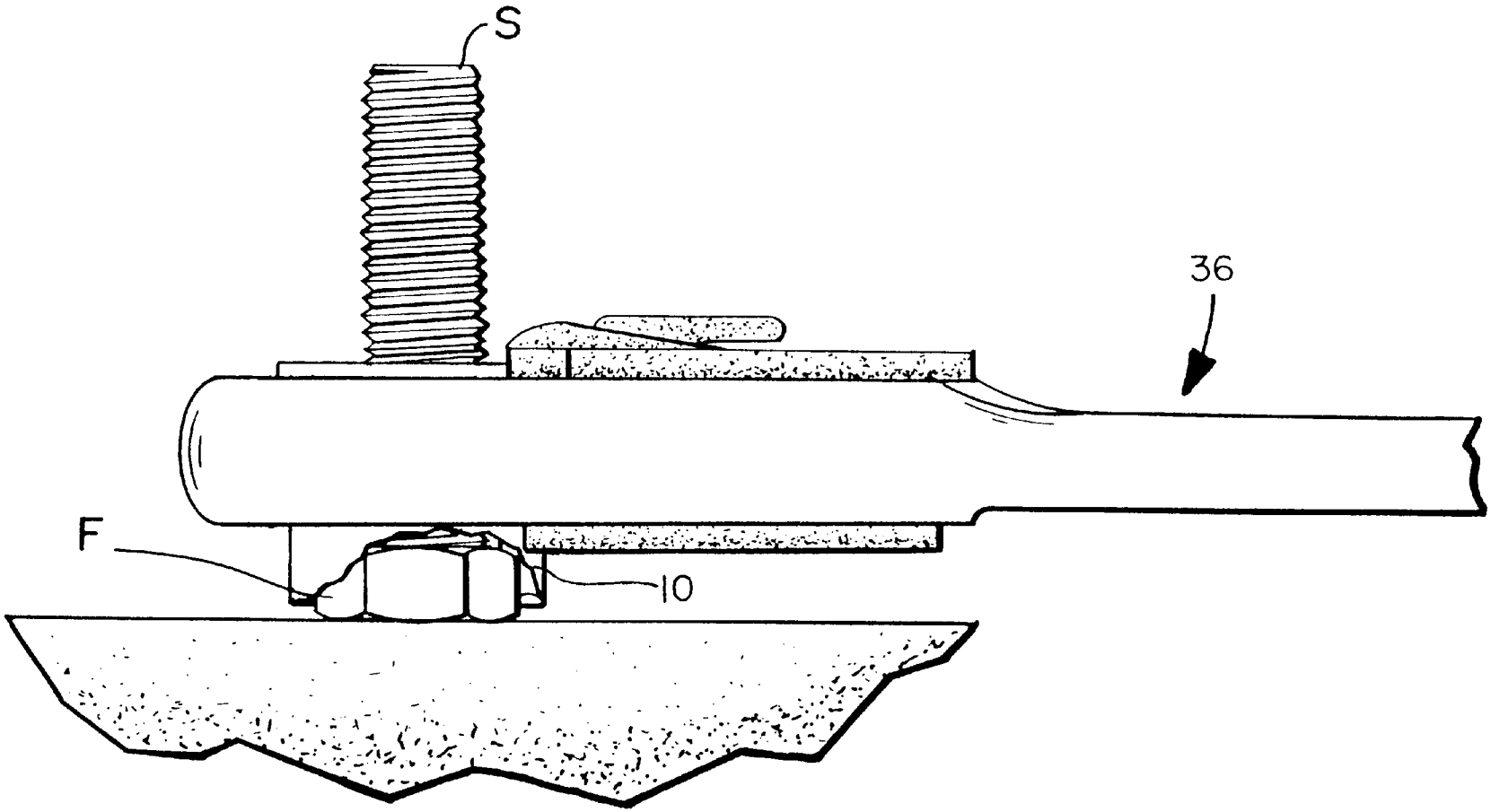
FIG. 11 is a partial cut-away side elevation view of the socket of the present invention in a ratchet wrench and a shaft of a bolt extending through the socket.

As shown in FIG. 11, the socket 10 of the present invention, having a bolt hole clearance therein, may be used with a fastener F which is threaded on an elongated screw S. The ratchet wrench 36 with the attached socket 10 is disposed with the screw S extending through opening 18 in the first portion 12 and through the opening 32 in the second portion of the socket 10. In this manner, the ratchet wrench 36 and socket 10 of the present invention has increased versatility in its use.

Figure 12:
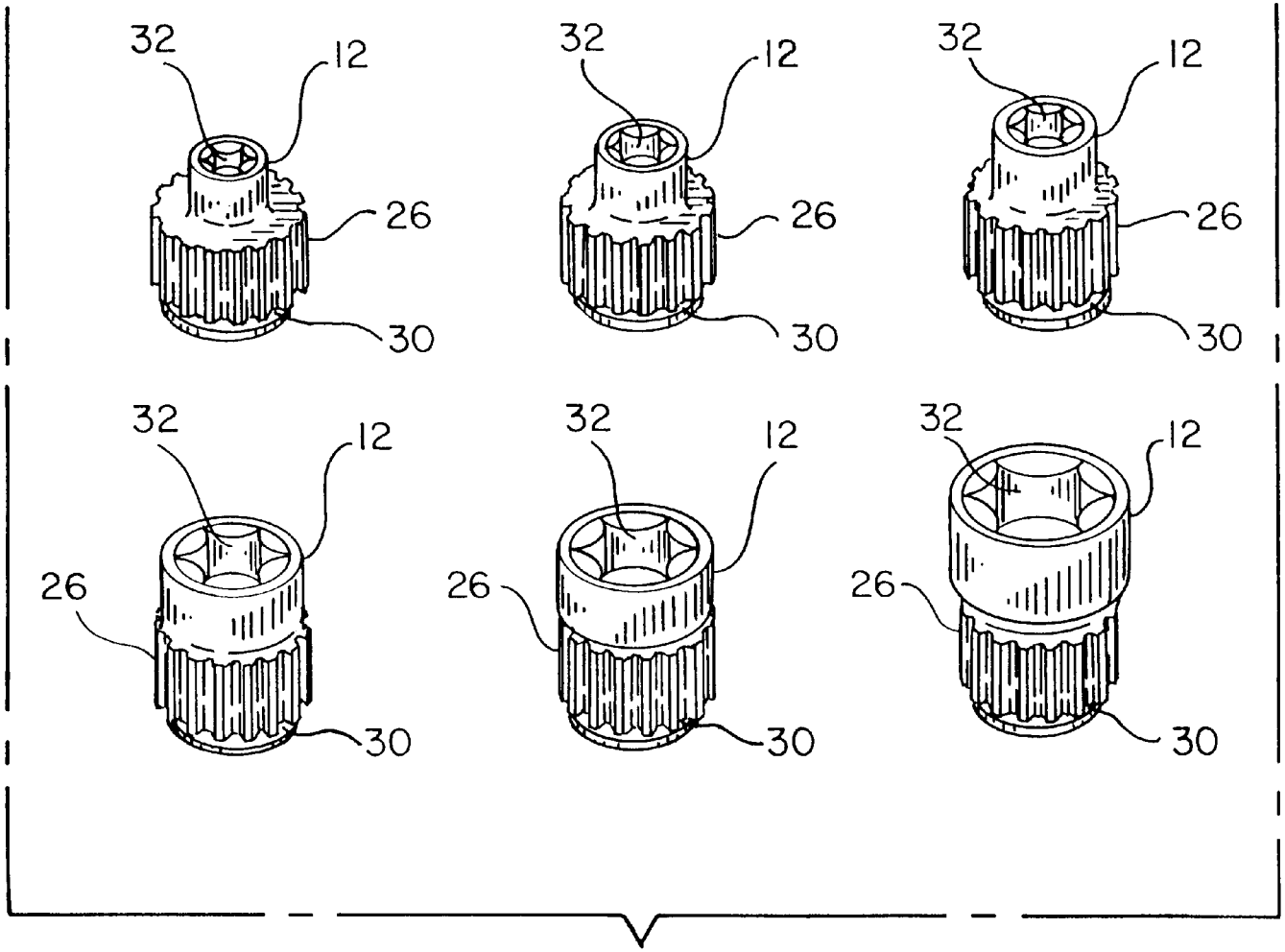
FIG. 12 is a perspective view of a set of sockets having a portion to fit different size fasteners.

A plurality of sockets 10 (FIG. 12), each having identical exterior ratchet gears 26 and each having an opening 18 with a different size cross section to receive a different size fastener, provides a capability to use the ratchet wrench 36 with a spectrum of fasteners. In this manner, a set of sockets having a full range to be used with fasteners of fraction and metric dimensions is possible. The cross section of the second portion 14 of each of the sockets 10 of the set is uniform to be interchangeably received in the opening 34 in the head of the ratchet wrench 36.

Figure 13:
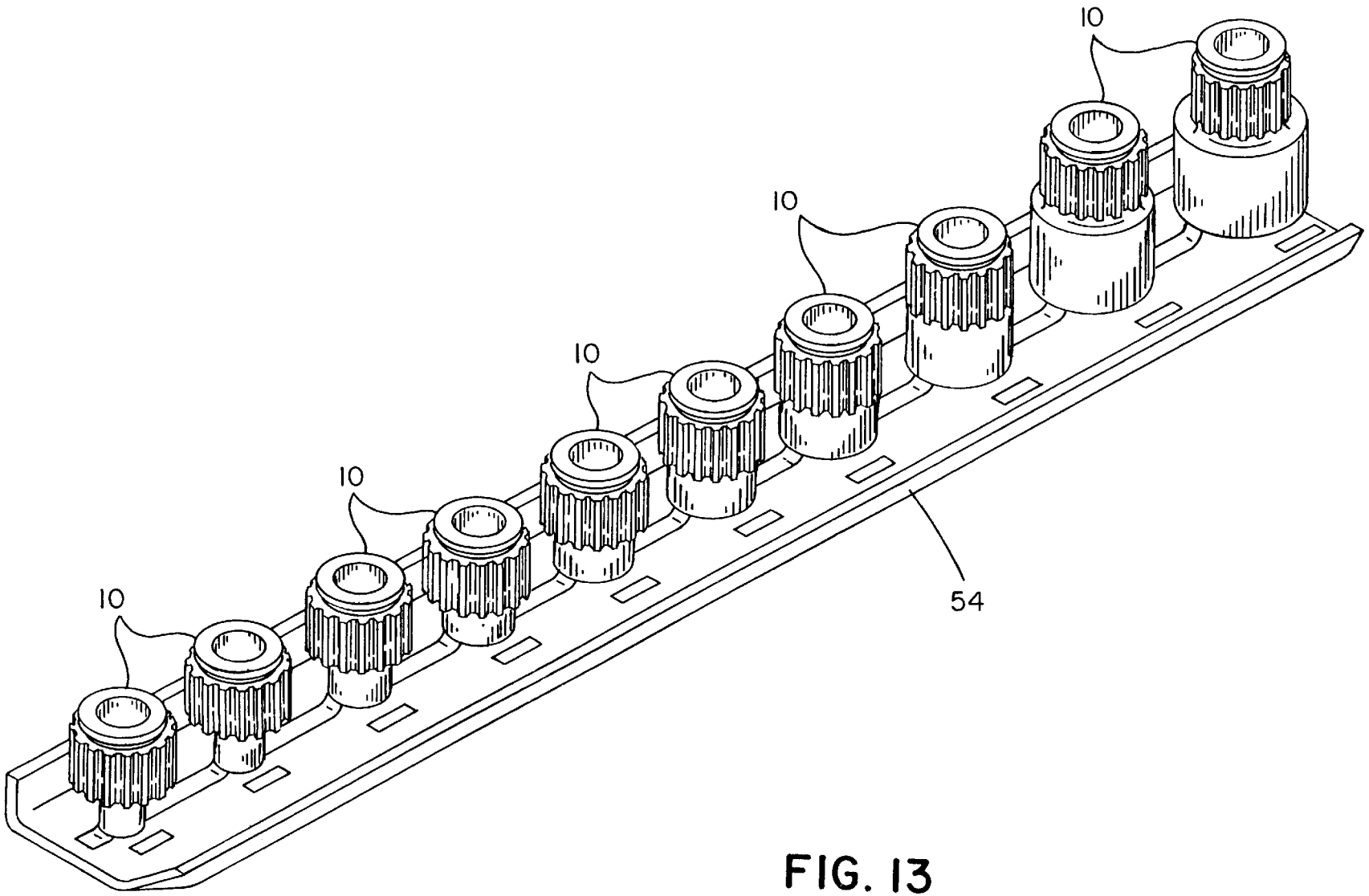
FIG. 13 is a perspective view showing a set of sockets of the present invention mounted on a socket holder.

The set of sockets may be conveniently stored on a socket holder 54 (FIG. 13) or in a container for ease of selection of the size required to engage the fastener.

Figure 14:
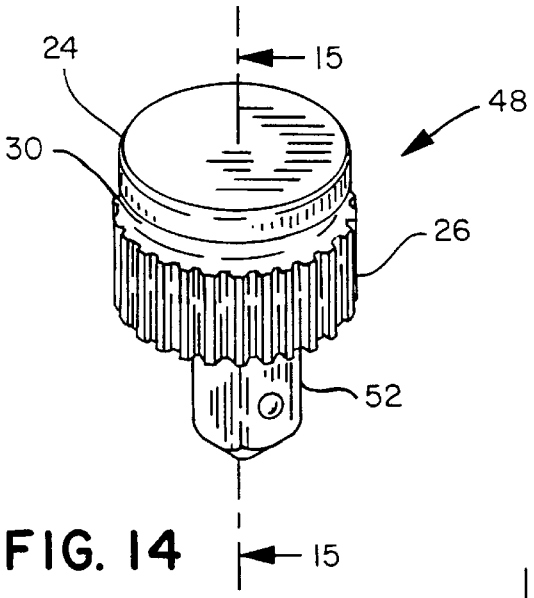
FIG. 14 is a perspective view of an adapter for the ratchet wrench.
Figure 15:
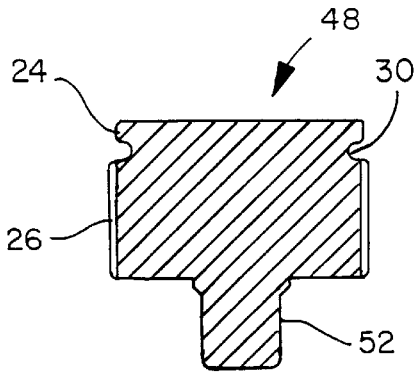
FIG. 15 is a cross-sectional view across the lines 15—15 of FIG. 14.
Figure 16:
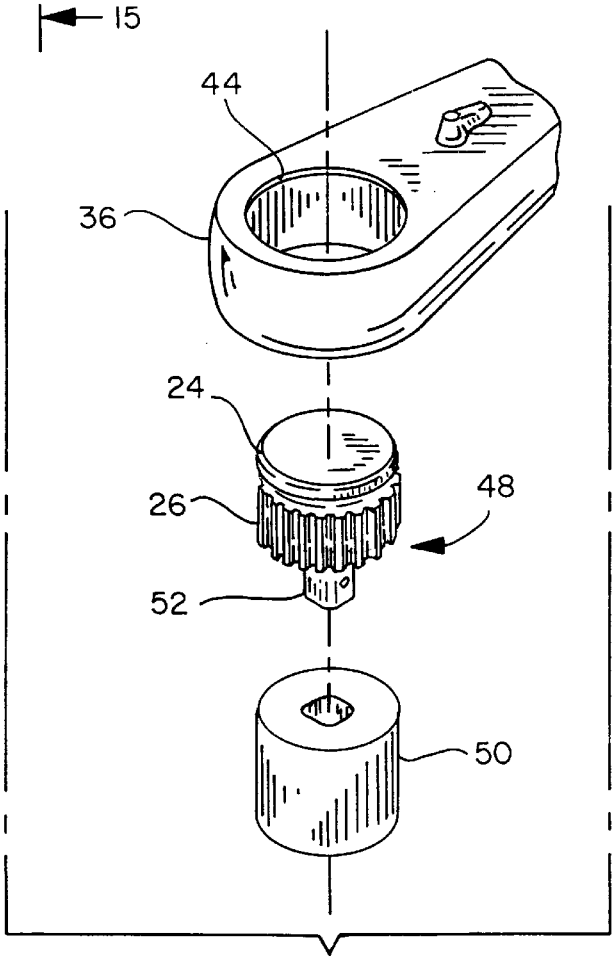
FIG. 16 is an exploded view showing the ratchet wrench, the adapter and a conventional socket.

As shown in FIGS. 14–16, an adapter 48 may be used to permit the low profile ratchet wrench 36 to be used with a selected one of a plurality of conventional sockets 50 and accessories. The adapter 48 has a portion having a plurality of gear teeth 26 formed axially and circumferentially thereabout in a manner as previously described for the sockets. The dimensions of the portion of the adapter and the teeth are identical to those of the previously described sockets. Also, there is an annular shoulder 24 and an annular groove 30 formed on the adapter identical to those on the sockets. A drive tang 52 is formed on the adapter 48 at the base of the gear teeth 26 and distal from the annular shoulder 24. The drive tang 52 is configured to be received in the square opening in any one of a set of conventional sockets and accessories and is, in this manner, identical to a conventional drive tang. The adapter 48 enables the low profile wrench of the present invention to be more versatile.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A socket in combination with a ratchet wrench to be received in an opening in a head of the ratchet wrench and to cooperate with a pawl means disposed in the head of the ratchet wrench, the ratchet wrench having a top surface, the socket comprising, a first axial portion and an integral second axial portion, the first axial portion having an opening therein, the opening having surfaces for engaging a fastener of a predetermined size, the second axial portion having an end distal from the first axial portion, an annular shoulder being formed on said end, a ratchet gear being formed externally axially and circumferentially on the second axial portion, an external annular groove being formed between the annular shoulder and the ratchet gear on the second axial portion, and resilient means disposed in the head of the ratchet wrench cooperating with the external annular groove, wherein the socket is manually insertable in the head of the ratchet wrench and manually removable from the head of the ratchet wrench by pushing the socket from the top surface of the ratchet wrench.

2. The socket of claim 1, wherein an annular groove is formed in the opening in the head of the wrench, the resilient means being disposed in the annular groove in the head of the wrench and removably retaining the socket in the head of the ratchet wrench.

3. The socket of claim 1, wherein the resilient means is a wire ring.

4. The socket of claim 1, further comprising a stop means being formed in the opening in the head of the ratchet wrench, the stop means contacting the socket when the socket is inserted into the opening and preventing passage of the socket through the opening in the head.

5. The socket of claim 1, wherein gear teeth are formed on the second axial portion of the socket, the gear teeth have an end distal from the first portion of the socket, an annular lip being formed at least partially circumferentially about the opening in the head of the ratchet wrench, the end of the gear teeth abutting the annular lip when the socket is inserted into the head, preventing passage of the socket through the opening in the head.

6. The socket of claim 1, further comprising an opening formed axially in the second axial portion of the socket, the opening in the second axial portion cooperating with the opening in the first axial portion forming a throughhole in the socket, wherein an elongated threaded screw having the fastener thereon extends through the throughhole.

7. The socket of claim 6, wherein the opening in the second axial portion of the socket is square, having a predetermined cross section, the predetermined cross section permitting the socket to be received on a tang of a conventional ratchet wrench.

8. The socket of claim 1, further comprising a channel formed between the ratchet gear and the first axial portion.

9. A set of wrench sockets in combination with a ratchet wrench, the ratchet wrench having a top surface adjacent to an opening in the head of the ratchet wrench, each socket being intended to be received within the opening formed in the head of the ratchet wrench and to cooperate therein directly with a pawl means in the ratchet wrench, thereby eliminating the necessity for a conventional ratchet gear in the ratchet wrench, and thereby substantially reducing the size of the ratchet wrench, each of the wrench sockets comprising respective first and second axial portions, the first axial portions of the respective wrench sockets including respective socket openings, each of which has a different size, the second respective axial portions being identical for all of the wrench sockets, the second axial portion of each wrench socket including an annular shoulder at an end thereof and further including a ratchet gear formed externally thereon and intermediately of the second axial portion, the ratchet gear being intended to cooperate directly with the pawl means in the ratchet wrench, the second portion of the wrench further having an external annular groove formed thereon, the external annular groove being disposed between the ratchet gear and the annular shoulder and being adapted to cooperate with a resilient means in the head of the ratchet wrench, thereby manually releasably retaining any selected one of the set of wrench sockets within the head of the ratchet wrench, the socket being manually released by pushing the socket from the top surface of the ratchet wrench.

10. In a ratchet wrench having a head portion having a top surface and a bottom surface, provided with an opening in the head portion and further having a pawl cooperating directly with a selected one of a plurality of interchangeable gear sockets, said selected gear socket being received in the opening in the head portion of the wrench and being releasably retained therein, each of the gear sockets having an upper portion having a height and provided with an identical gear formation adapted to engage the pawl, the gear formation being a plurality of spaced-apart gear teeth extending axially the height of the upper portion, and each of the gear sockets further having a lower cylindrical portion having a given diameter and provided therein with a respective opening adapted to engage a fastener, the improvement comprising a single internal lip formed in the head portion of the ratchet wrench and projecting into the opening in the head portion of the wrench, such that the gear teeth of said selected gear socket abut against the internal lip when said selected gear socket is received into the opening in the head portion of the wrench, thereby accommodating the bearing thrust loads between said selected gear socket and the wrench, the lower cylindrical portion of said selected gear socket avoiding contact with the bottom surface of the head, and thereby accommodating any given diameter of the lower cylindrical portions of the gear sockets and the respective openings formed therein.

11. The ratchet wrench of claim 10, wherein the opening in each gear socket adapted to engage a fastener is a portion of a through opening in the respective gear socket.

12. A ratchet wrench having a handle and a head portion connected thereto, the wrench comprising:

a through opening being formed in the head portion, a pawl having teeth thereon disposed in the head portion wherein the pawl teeth communicate with the opening in the head portion, a plurality of interchangeable gear sockets, a selected one of the plurality of gear sockets being received in the opening in the head portion of the wrench and being releasably retained therein by retention means, each of the gear sockets having an upper portion provided with an identical gear formation having a height, the gear teeth extending the height of the upper portion, the gear teeth adapted to engage the pawl teeth, and each of the gear sockets further having a lower cylindrical portion having a given diameter and provided therein with a respective opening adapted to engage a fastener, wherein the selected gear socket may be manually inserted and removed from the opening, and a single abutting engagement means preventing the selected socket from being inserted through the opening in the head, wherein the abutting engagement means abuts the gear teeth on the upper portion of the socket, said abutting engagement means being independent of the retention means and said abutting engagement means being independent of the diameter of the lower cylindrical portion of the respective gear sockets.

13. The ratchet wrench of claim 12, further comprising each of the gear sockets having a through hole formed therein whereby an extended bolt to which the fastener is attached may be received in the through hole.

* * * * *